US008957646B2

(12) United States Patent
Nagata et al.

(10) Patent No.: US 8,957,646 B2
(45) Date of Patent: Feb. 17, 2015

(54) CONSTANT VOLTAGE CIRCUIT AND ELECTRONIC DEVICE INCLUDING SAME

(71) Applicants: Toshihisa Nagata, Hyogo (JP); Takahiro Hino, Osaka (JP); Akihito Nagahama, Osaka (JP)

(72) Inventors: Toshihisa Nagata, Hyogo (JP); Takahiro Hino, Osaka (JP); Akihito Nagahama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 13/719,454

(22) Filed: Dec. 19, 2012

(65) Prior Publication Data

US 2013/0154605 A1 Jun. 20, 2013

(30) Foreign Application Priority Data

Dec. 20, 2011 (JP) ..... 2011-278561

(51) Int. Cl.
*G05F 1/573* (2006.01)
*G05F 3/02* (2006.01)

(52) U.S. Cl.
CPC ..... *G05F 3/02* (2013.01)
USPC ..... 323/277; 323/275

(58) Field of Classification Search
CPC ..... G05F 1/56; G05F 1/565; G05F 1/573; G05F 1/5735; G05F 1/575; H02M 1/44; H02M 3/33507; H02M 3/33515
USPC ..... 323/273–277; 361/87, 93.9
See application file for complete search history.

(56) References Cited

U.S. PATENT DOCUMENTS

| | | | | |
|---|---|---|---|---|
| 7,215,180 | B2 * | 5/2007 | Nagata et al. | 327/538 |
| 7,315,154 | B2 * | 1/2008 | Sugiura | 323/276 |
| 7,359,171 | B2 * | 4/2008 | Yoshida | 361/93.9 |
| 7,511,464 | B2 * | 3/2009 | Suzuki | 323/275 |
| 7,629,711 | B2 * | 12/2009 | Zhong et al. | 307/103 |
| 7,675,763 | B2 * | 3/2010 | Okuda et al. | 363/89 |
| 7,710,090 | B1 * | 5/2010 | Kimura | 323/276 |
| 7,768,339 | B2 * | 8/2010 | Suzuki | 327/513 |
| 7,772,815 | B2 * | 8/2010 | Okuda et al. | 323/280 |
| 8,384,370 | B2 * | 2/2013 | Nakashimo | 323/316 |
| 8,450,986 | B2 * | 5/2013 | Imura et al. | 323/277 |

(Continued)

FOREIGN PATENT DOCUMENTS

| | | |
|---|---|---|
| JP | 2003-186554 | 7/2003 |
| JP | 2004-234619 | 8/2004 |

(Continued)

*Primary Examiner* — Gary L Laxton
*Assistant Examiner* — Kevin H Sprenger
(74) *Attorney, Agent, or Firm* — Cooper & Dunham LLP

(57) ABSTRACT

A constant voltage circuit includes an output control transistor to control an output current from an output terminal to keep an output voltage constant at a set voltage; and an excess-current protection circuit to control the output control transistor. The excess-current protection circuit includes a current increase restriction element to restrict increase in the output current to decrease the output voltage; a first current limitation circuit to limit a gate voltage of the output control transistor to decrease the output current, when the output voltage is decreased to a first limited voltage; a second current limitation circuit to limit a gate voltage of the output control transistor to decrease the output current, when the output voltage is decreased to a second limited voltage smaller than the first limited voltage; and a selector to select whether the first current limitation circuit is operated or stopped.

12 Claims, 13 Drawing Sheets

(56) References Cited

U.S. PATENT DOCUMENTS

| | | | |
|---|---|---|---|
| 2003/0128489 | A1 | 7/2003 | Katoh et al. |
| 2005/0036246 | A1 | 2/2005 | Nagata et al. |
| 2005/0231180 | A1 | 10/2005 | Nagata et al. |
| 2007/0115045 | A1 | 5/2007 | Nagata et al. |
| 2008/0197829 | A1 | 8/2008 | Nagata et al. |
| 2008/0238385 | A1 | 10/2008 | Nagata et al. |
| 2008/0278127 | A1 | 11/2008 | Nagata |
| 2010/0277150 | A1 | 11/2010 | Nagata |

FOREIGN PATENT DOCUMENTS

| | | |
|---|---|---|
| JP | 2008-47158 | 2/2008 |
| JP | 2012-33122 | 2/2012 |

* cited by examiner

CONSTANT VOLTAGE CIRCUIT AND ELECTRONIC DEVICE INCLUDING SAME

CROSS-REFERENCE TO RELATED APPLICATION

This patent application is based on and claims priority pursuant to 35 U.S.C. §119 to Japanese Patent Application No. 2011-278561, filed on Dec. 20, 2011 in the Japan Patent Office, the entire disclosure of which is hereby incorporated by reference herein.

BACKGROUND

1. Technical Field

The present disclosure relates to a constant voltage circuit including an excess-current protection circuit to protect against excess current by alternately decreasing output voltage and output current in stages, and an electronic device including the constant voltage circuit.

2. Description of the Related Art

FIG. 1 is a circuit diagram illustrating a known constant-voltage circuit 100-X that changes an output voltage and an output current in stages. The constant-voltage circuit 100-X includes, in addition to an excess-current protection circuit 10*e*, a reference voltage generator circuit 1 to generate a reference voltage Vref, an error amplifier 2, an output MOS transistor M1, and an output detection circuit 3 including a variable resistor R21 and a fixed resistor R22. The excess-current protection circuit 10*e* includes MOS transistors M112, M113, M114, M151, and M152 and resistors R123, R124, R125 and R29. The configuration of the constant-voltage circuit 100-X is typical and thus a description thereof is omitted. The operation of the excess-current protection circuit 10*e* is described below.

FIG. 2 is a graph illustrating the characteristics of an output voltage Vout relative to an output current Iout of the constant-voltage circuit 100-X.

In the constant-voltage circuit 100-X of FIGS. 1 and 2, a source and a gate of the MOS transistor M112 are connected to a source and agate of the MOS transistor M1, and a drain current of the output MOS transistor M112 is proportional to a drain current of the MOS transistor M1. Then, the drain current of the MOS transistor M112 flows through the resistor R123, which generates a voltage across the resistor R123.

When the voltage across the resistor R123 reaches a threshold voltage of the MOS transistor M113, the MOS transistor M113 is turned on. The drain current of the MOS transistor M113 generates a voltage across the resistor R29 to switch the MOS transistor M114 on.

Herein, since the drain of the MOS transistor M114 is connected to the gate of the output MOS transistor M1, the MOS transistor M114 is switched on, which acts to increase gate voltage of the output MOS transistor M1. Accordingly, an increase in the output current Iout of the output M1 is suppressed, and then the output voltage Vout starts declining. The output current Iout at this time is a first limited current IL1.

The MOS transistor M151 is set to be on while the output voltage Vout is at or over a predetermined voltage. When an excess current flows and the output voltage Vout declines to a first limited voltage $V_{L1}$ through the above-described process, a junction voltage VFB between the resistors R21 and R22 of the output voltage detection circuit 3 is decreased, which decreases the gate voltage of the MOS transistor M151. When a gate voltage of the MOS transistor M151 is decreased to the predetermined voltage, the MOS transistor M151 is switched off, and the drain current of the MOS transistor M112 flows through not only the resistor R123 but also the resistor R124. Accordingly, a gate voltage of the MOS transistor M113 is increased, which increases the gate voltage of the output MOS transistor M1 via the MOS transistors M113 and M114, and decreases the output current Iout of the constant-voltage circuit 100-X from the first limited current IL1 to a second limited current IL2.

As the output voltage Vout is decreased to a second limited voltage $V_{L2}$ through the foregoing process, the MOS transistor M152 is switched off, and the drain current of the MOS transistor M112 flows not only to the resistor R125 but also to the resistors R123 and R124. Accordingly, the gate voltage of the MOS transistor M113 is increased, which further increases the gate voltage of the output MOS transistor M1 via the MOS transistors M113 and M114, and further decreases the output current Iout of the constant-voltage circuit 100-X from the second limited current IL2 to a third limited current IL3.

Accordingly, the constant-voltage circuit 100-X shown in FIG. 1 changes the output voltage Vout and the output current Iout in stages, as shown in FIG. 2.

In a constant-voltage circuit configured as described above, a package of the power supply integrated circuit (IC) is compact and power dissipation is not great. Therefore, when the excess current flows through the constant-voltage circuit 100-X, heat generation is prevented using the excess-current protection circuit that alternately changes the output voltage and the output current in stages and prevents delay in rising speed.

However, when a connected load fluctuates significantly, the undershoot of the output voltage is great. As a result, the output voltage Vout is trapped at a first step (e.g., first limited voltage $V_{L1}$) of the excess-current protection circuit 10*e*, which may generate the failure that the output voltage Vout is not recovered from the trapped step. In particular, when the output voltage Vout is set at a low value, a voltage difference between an output setting voltage Vset and the first step voltage in stages is smaller, the non-recover failure is more likely to occur.

BRIEF SUMMARY

In one aspect of this disclosure, there is provided constant voltage circuit including an output terminal, an output control transistor, and an excess-current protection circuit. The output terminal outputs an output voltage. The output control transistor controls an output current from the output terminal to keep the output voltage constant at a predetermined set voltage. The excess-current protection circuit controls the output control transistor to prevent an output current, output from the output control transistor, from exceeding a predetermined value. The excess-current protection circuit includes a current increase restriction element, a first current limitation circuit, a second current limitation circuit, and a selection element. The current increase restriction element restricts increase in the output current from the output control transistor to decrease the output voltage from the output terminal. The first current limitation circuit limits a gate voltage of the output control transistor to decrease the output current, when the output voltage decreases to a first limited voltage from the predetermined set voltage. The second current limitation circuit limits a gate voltage of the output control transistor to decrease the output current, when the output voltage decreases to a second limited voltage that is smaller than the first limited voltage from the predetermined set voltage or the first limited value. The selection element selects whether the first current limitation circuit is operated or stopped.

In another aspect of this disclosure, there is provided an electronic device employing the above-described constant-voltage circuit and a load connected to the constant voltage circuit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
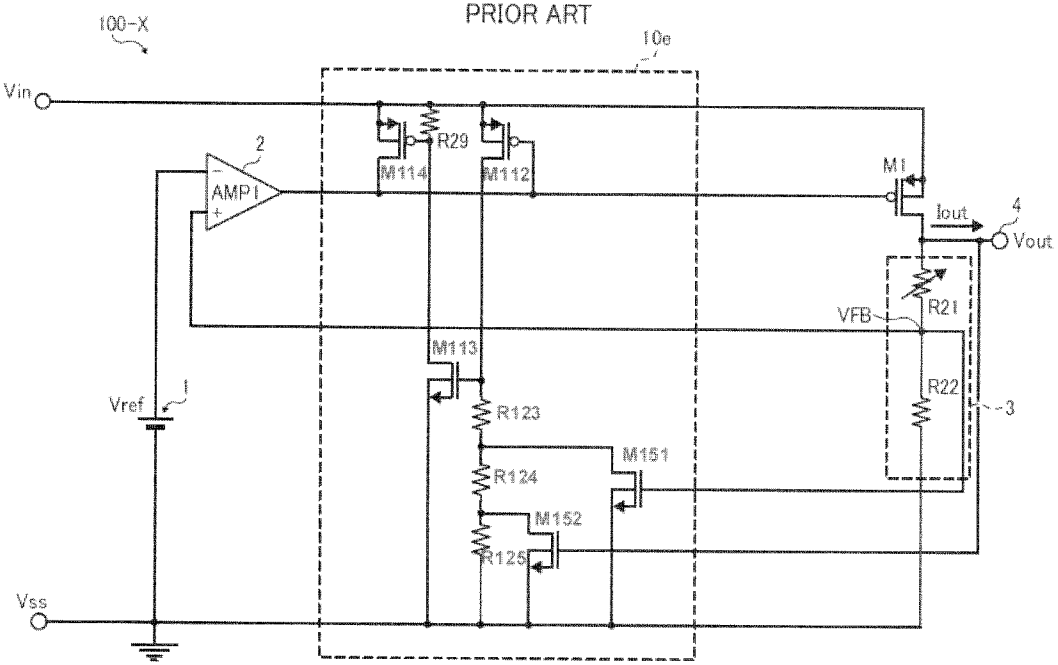
FIG. 1 PRIOR ART
FIG. 1 is a circuit diagram illustrating a constant voltage circuit including a conventional excess-current protection circuit.
Figure 2:
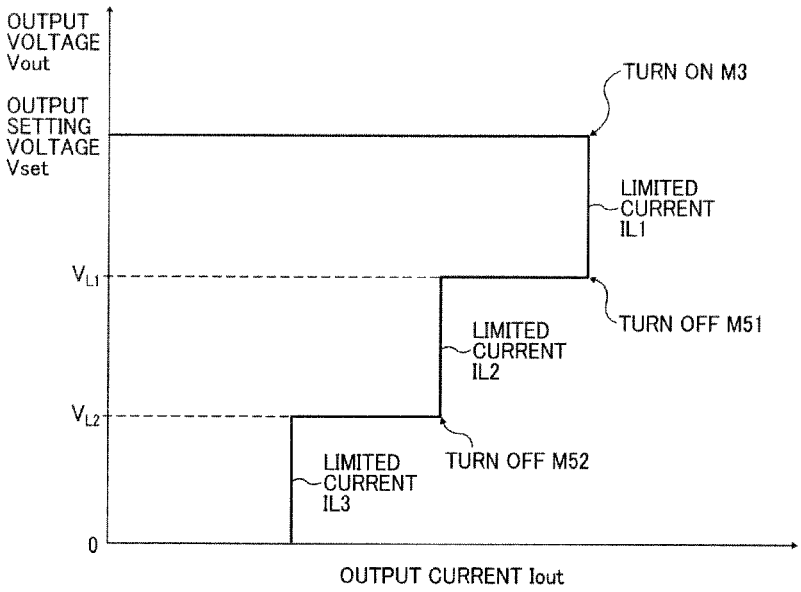
FIG. 2 PRIOR ART
FIG. 2 is a graph illustrating characteristics of an output voltage relative to an output current of operation of the constant-voltage circuit shown in FIG. 1.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result. Referring now to the drawings, wherein like reference numerals designate identical or corresponding parts throughout the several views thereof, and particularly to FIGS. 3A through 12, a constant voltage circuit according to illustrative embodiments of the present disclosure is described.

First Embodiment

Figure 3A:
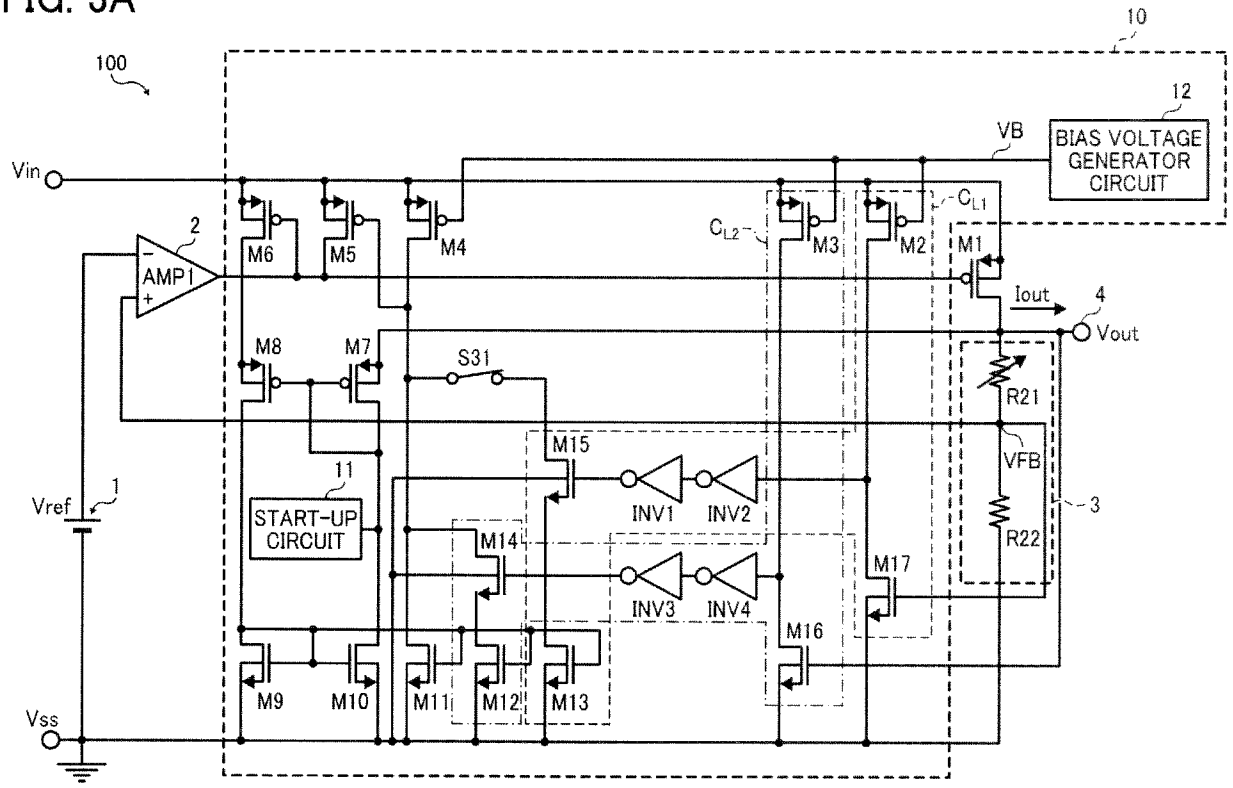
FIG. 3A is a circuit diagram illustrating a configuration of a constant-voltage circuit including an excess-current protection circuit according to a first embodiment of the present disclosure.

FIG. 3A is a circuit diagram illustrating a configuration of a constant-voltage circuit 100 including an excess-current protection circuit 10 according to a first embodiment. In FIG. 3A, the constant-voltage circuit 100 includes, in addition to the excess-current protection circuit 10, a reference voltage generator 1, an error amplifier 2, an output-voltage detection circuit 3, an output terminal 4, and an output MOS transistor (output control transistor) M1. The reference voltage generator 1 generates a reference voltage Vref. The output-voltage detection circuit 3, including a variable resistor R21 and a fixed resistor R22, detects an output voltage Vout. The error amplifier 2 amplifies a voltage difference between the reference voltage Vref and a junction voltage VFB between the resistors R21 and R22. The output MOS transistor M1 is controlled by an output voltage of the error amplifier 2, which controls the output voltage Vout of the constant-voltage circuit 100. The excess-current protection circuit 10 includes MOS transistors M2 through M17, inverters INV1 through INV4, a switch S31, a bias voltage generator circuit 12 to generate a bias voltage VB (which is described later with reference to FIG. 8), and a start-up circuit 11 to generate a predetermined start-up voltage when the excess-current protection circuit 10 is activated.

In FIG. 3A, the switch S31 is off in normal state. A source and a gate of the MOS transistor M6 are connected to a source and a gate of the output MOS transistor M1, and accordingly, a current through the drain of the MOS transistor M6 is proportional to a current flowing through the output MOS transistor M1. Thus, the MOS transistor M6 serves as a proportional current generator. The drain current of the MOS transistor M6 flows from the MOS transistor M8 to the MOS transistor M9, which generates source-gate voltages of the respective MOS transistors M9, M10, M11, M12, and M13. At this time, the drain voltages of the MOS transistor M6 and the output MOS transistor M1 are kept at same voltage level by the MOS transistors M8 and M7. In addition, the start-up circuit 11 drops a voltage at a connected node to 0 V once during start-up. The certain bias voltage VB is applied to the gates of the MOS transistors M2, M3, and M4, and the MOS transistors M2, M3, and M4 function as constant current sources.

In the excess-current protection circuit 10, the MOS transistor M2, M17, M13, and M15, and the inverters INV1 and INV2 function as a first current limitation circuit $C_L$, and the MOS transistor M3, M16, M12, and M14, and the inverters INV3 and INV4 function as a second current limitation circuit $C_{L2}$. The transistor M5 serves as a current increase restriction element. In the first current limitation circuit $C_{L1}$, the MOS transistor M17 serves as a first detection transistor to generate a first drain voltage depending on the junction voltage (divided voltage) VFB from the output voltage detection circuit 3, the inverter INV2 serves as a first inverter to generate a first threshold voltage, and the MOS transistor M15 serves as a first operation transistor to switch on when the first drain voltage of the first detection transistor M17 exceeds the first threshold voltage of the first inverter INV2. In the second current limitation circuit $C_{L2}$, the MOS transistor M16 serves as a second detection transistor to generate a second drain voltage depending on the output voltage Vout of the output terminal 4, the inverter INV4 serves as a second inverter to generate a second threshold voltage, and the MOS transistor M14 serves as a second operation transistor to switch on when the second drain voltage of the second detection transistor M16 exceeds the second threshold voltage of the second inverter INV4. In addition, the transistor M5, the reference voltage generator 1, the error amplifier 2, the output-voltage detection circuit 3 together function as a current increase restriction circuit. The switch S31 serves as a selection element to select whether the first current limitation circuit $C_{L1}$ is operated or stopped.

Figure 4:
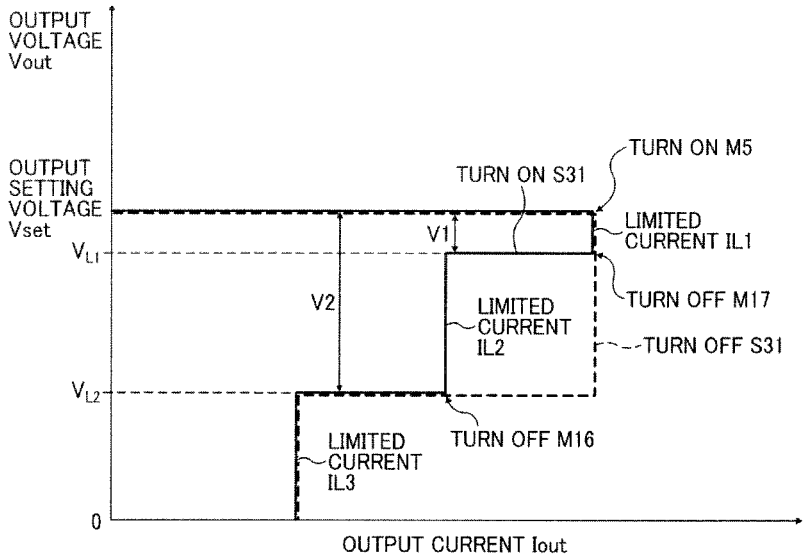
FIG. 4 is a graph illustrating the characteristics of an output voltage relative to an output current of the constant-voltage circuit shown in FIG. 3A.

FIG. 4 is a graph illustrating the characteristics of the output voltage Vout relative to an output current Iout of the constant-voltage circuit 100 shown in FIG. 3A. In FIG. 4, a solid line represents the operation while the switch S31 is on, and a broken line represents the operation while the switch S31 is off.

In FIG. 4, in a state in which the switch S31 is on (indicated by the solid line), the drain of the MOS transistor M5 is connected to the gate of the output MOS transistor M1. In this state, the MOS transistor M5 is switched on, which acts to increase the gate voltage of the output MOS transistor M1. Therefore, an increase in the output current Iout is suppressed and the output voltage Vout starts decreasing. Herein, the MOS transistor M17 is set to be on while the output voltage Vout is at or over a predetermined voltage. The output current Iout is set at a first limited current IL1 at this time.

Subsequently, as the excess current flows, and as the output voltage Vout is decreased to the first limited voltage $V_{L1}$ from a output setting voltage (predetermined set voltage) Vset while the output current Iout is kept at the first limited current IL1, the junction voltage VFB between the resistors R21 and R22 in the output voltage detector circuit 3 is decreased, which decreases the gate voltage of the MOS transistor M17. Then, when the gate voltage of the MOS transistor M17 is decreased to the predetermined voltage, the MOS transistor M17 is tuned off. In addition, when the drain voltage of the MOS transistor M17 exceeds an a first threshold voltage of the inverter INV2, the MOS transistor M15 is switched on, a gate-source voltage of the MOS transistor M5 is increased, and the gate voltage of the output MOS transistor M1 is increased. Accordingly, the output current Iout of the constant-voltage circuit 100 is decreased to a second limited current IL2 from the first limited current IL1 while the output voltage Vout is kept at the first limited voltage $V_{L1}$.

Then, when the output voltage Vout is further decreased to a second limited voltage $V_{L2}$ through the above-described process, the MOS transistor M16 is turned off. Then, when the drain voltage of the MOS transistor M16 exceeds a second threshold value of the inverter INV4, the MOS transistor M14 is switched on, the gate-source voltage of the MOS transistor M5 is further increased, and the gate voltage of the output MOS transistor M1 is increased. Accordingly, the output current Iout of the constant-voltage circuit 100 is further decreased to a third limited current IL3 from the second limited current IL2 while the output voltage Vout is kept at the second limited voltage $V_{L2}$.

Accordingly, as illustrated in the solid line shown in FIG. 4, while the switch S31 is on, the constant-voltage circuit 100 of the present embodiment alternatively changes the output voltage Vout and the output current Iout in stages using a first step operated by the first current limitation circuit $C_{L1}$ and a second step operated by the second current limitation circuit $C_{L2}$.

Conversely, in a state in which the switch S31 is off, in the excess-current protection circuit 10, when the excess current flows and the output voltage Vout declines to the first limited voltage $V_{L1}$ through the foregoing process, the MOS transistor M17 is turned off. Then, in a state in which the drain voltage of the MOS transistor M17 exceeds the first threshold value of the inverter INV2, when the MOS transistor M15 is switched off, which does not influence to the gate-source voltage of the MOS transistor M5. Therefore, the gate voltage of the output MOS transistor M1 is not increased, and the output current Iout of the constant-voltage circuit 100 is not decreased. That is, the output current Iout is not changed to the second limited current IL2, but is kept at the first limited current IL1 until output voltage Vout is decreased to the second limited voltage $V_{L2}$.

Next, with reference to FIG. 4, the effect in the constant-voltage circuit 100 is described below. The solid line in FIG. 4 represents the operation of the excess-current protection circuit 10 while the switch 31 is on state. Herein, when the output setting voltage Vset is low, a voltage difference V1 between the output setting voltage Vset and the limited voltage (in this case, the first limited voltage $V_{L1}$) shown in FIG. 4 becomes smaller. In this condition, if the output voltage Vout is greatly undershoot as a load is rapidly increased, the failure that the output voltage Vout is not recovered from a trapped state in which the output voltage Vout is trapped in the first limited voltage $V_{L1}$ (hereinafter "recovery failure") is more likely to occur.

Conversely, the broken line shown in FIG. 4 represents the operation of the excess current-protection operation of the constant-voltage circuit 100 while the switch S31 is off, that is, while the operation of the first current limitation circuit $C_{L1}$ corresponding to the first step is stopped. In this condition, even if the output setting voltage Vset is low, a voltage difference V2 between the output setting voltage Vset and the limited voltage (in this case second limited voltage $V_{L2}$) shown in FIG. 4 is kept great. Therefore, if the output voltage Vout is greatly undershoot as the load is rapidly increased, the above-described recovery failure is less likely to occur.

In addition, in this embodiment, the switch S31 can be switched off by an external signal, for example, high-low signal from an integrated circuit (IC) external system. Accordingly, by switching the switch S31, the recovery failure is less likely to occur, without changing the circuit configuration of the constant-voltage circuit 100 depending on the condition of the connected load, which enables the optimal selection based on the load condition. When the constant-voltage circuit 100 is installed in a power management unit (PMU) or a composite power supply, using the configuration in which multiple user pins are prepared, and switch selection pin is selected from the multiple user pins, which does not increase the number of pins. Furthermore, setting whether the first step operation of the first current limitation circuit $C_{L1}$ stopped or not in all of or a part of the constant-voltage circuit 100 installed in the PWM or the composite power supply can be controlled by using only one pin.

Variation of First Embodiment

Figure 3B:
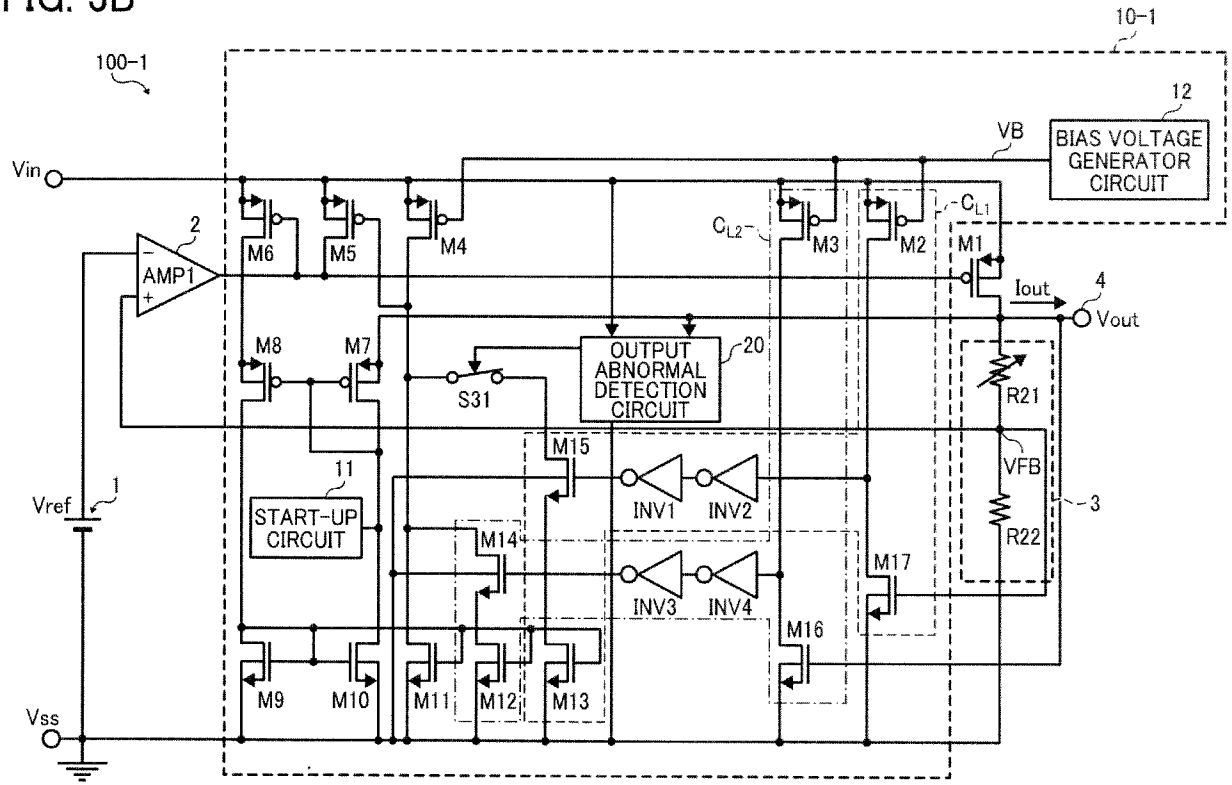
FIG. 3B is a circuit diagram illustrating a constant-voltage circuit including the excess-current protection circuit and an output-abnormal detection circuit according to a variation of the first embodiment.
Figure 3C:
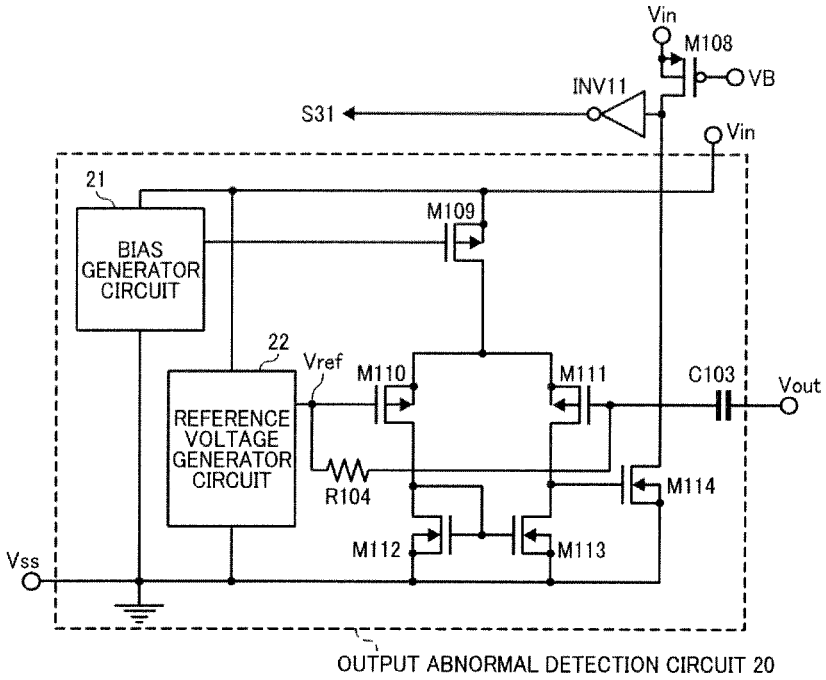
FIG. 3C is a circuit diagram illustrating a configuration of the output-abnormal detection circuit shown in FIG. 3B.

FIG. 3B is a circuit diagram illustrating a constant-voltage circuit 100-1 including an excess-current protection circuit 10-1 and an output-abnormal detection circuit (output detection circuit) 20 according to a variation of the first embodiment. FIG. 3C is a circuit diagram illustrating a configuration of the output-abnormal detection circuit 20 shown in FIG. 3B. In the constant-voltage circuit 100-1 including the output-abnormal detection circuit 20, if the great undershoot is generated inside the constant-voltage circuit 100-1 as the connected load rapidly changed, the output-abnormal detection circuit 20 detects the undershoot of the output voltage Vout and stops operation of the first step of the excess-current protection circuit 10-1 (stops operation of the first current limitation circuit $C_{L1}$) via the switch S31.

In FIG. 3C, the output-abnormal detection circuit 20 includes a bias generator circuit 21, a reference voltage generator circuit 22, MOS transistors M109 through M114, a resistor R104, and a capacitor C103. As external circuit of the output-abnormal detection circuit 20, a MOS transistor M108 and an inverter INV11 are connected to the output-abnormal detection circuit 20. In FIG. 3C, a voltage across the MOS transistor M109 is controlled by a gate voltage of the bias generator circuit 21. The reference voltage generator circuit 22 generates a reference voltage Vref. The MOS transistors M110 through M114 compare the output voltage Vout input via the capacitor C103 with the reference voltage Vref to detect a differential voltage for output as a control signal to the switch S31 via the external inverter INV11.

In the constant-voltage circuit 100-1 including the above-described output-abnormal detection circuit 20, the output-abnormal detection circuit 20 normally operates the switch S31 to keep on state. Alternatively, when the great undershoot of the output voltage Vout is generated, the output-abnormal detection circuit 20 transiently operates the switch S31 to turn off, which prevents the output voltage Vout from trapping in the first steps of the excess current protection operation and prevents the occurrence of the recovery failure.

Second Embodiment

Figure 5:
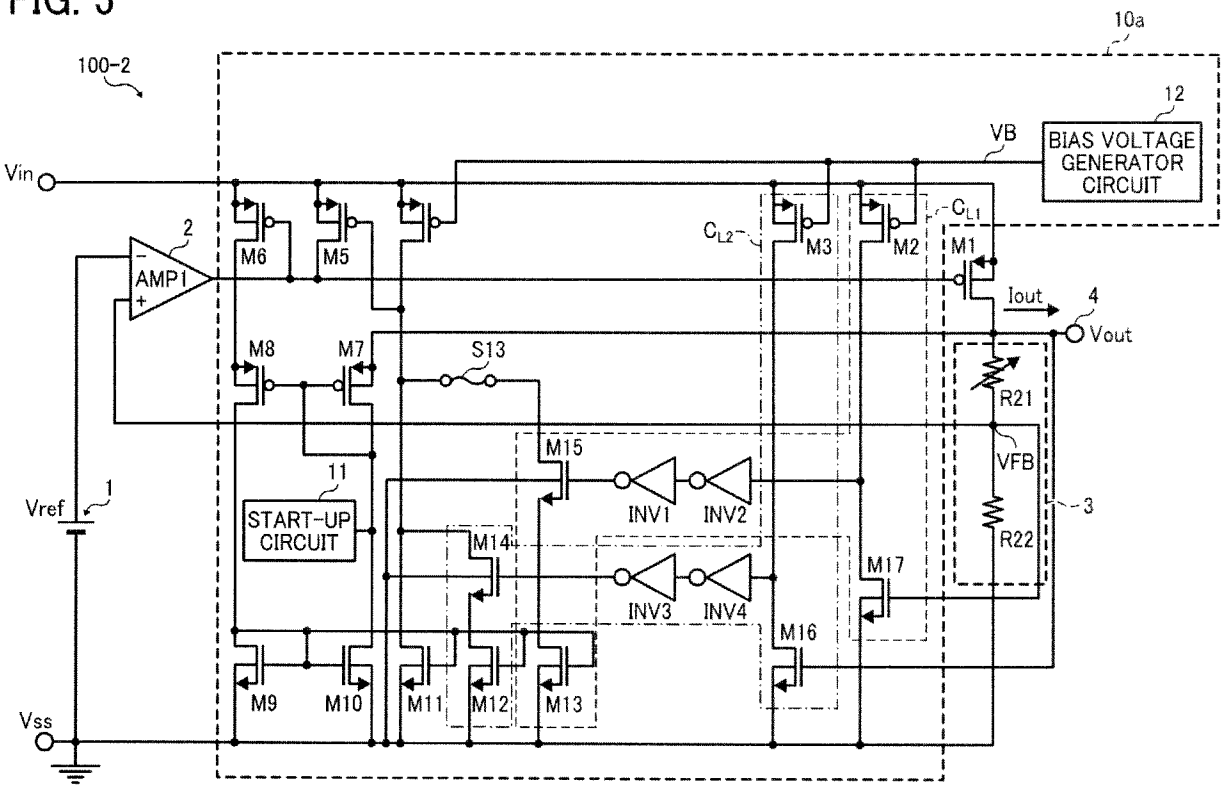
FIG. 5 is a circuit diagram illustrating a configuration of a constant-voltage circuit including an excess-current protection circuit according to a second embodiment.

FIG. 5 is a circuit diagram a configuration of a constant-voltage circuit 100-2 including an excess-current protection circuit 10*a* according to a second embodiment. Compared to the constant-voltage circuit 100 shown in FIG. 3A, the constant-voltage circuit 100-2 according to the second embodiment includes a trimming fuse 13 instead of the switch S31. The trimming fuse 13 serves as the selection element to select whether the first current limitation circuit $C_{L1}$ is operated or stopped.

In the above-configured constant-voltage circuit 100-2 according to the second embodiment, basic configuration is similar to the first embodiment, and the state in which the switch S31 is on corresponds to the state in which the trimming fuse 13 is not cut. The state in which the switch S31 is off corresponds to the state in which the trimming fuse 13 is cut. Accordingly, when the output setting voltage Vset is low, the trimming fuse 13 is cut, and the circuit performs the current protection operation without operating the first step in the first current limitation circuit $C_{L1}$ in stages. Therefore, if the output voltage Vout is greatly undershoot as the load is rapidly increased, the failure that the output voltage Vout is not recovered is less likely to occur.

In addition, since the trimming fuse 13 can be cut in the trimming process, in a state in which the output setting voltage Vset is low, the output setting voltage Vset is set by trimming, which can prevents the above-described recovery failure that the output voltage Vout is not recovered, without changing the setting of the constant-voltage circuit 100-2.

Third Embodiment

Figure 6:
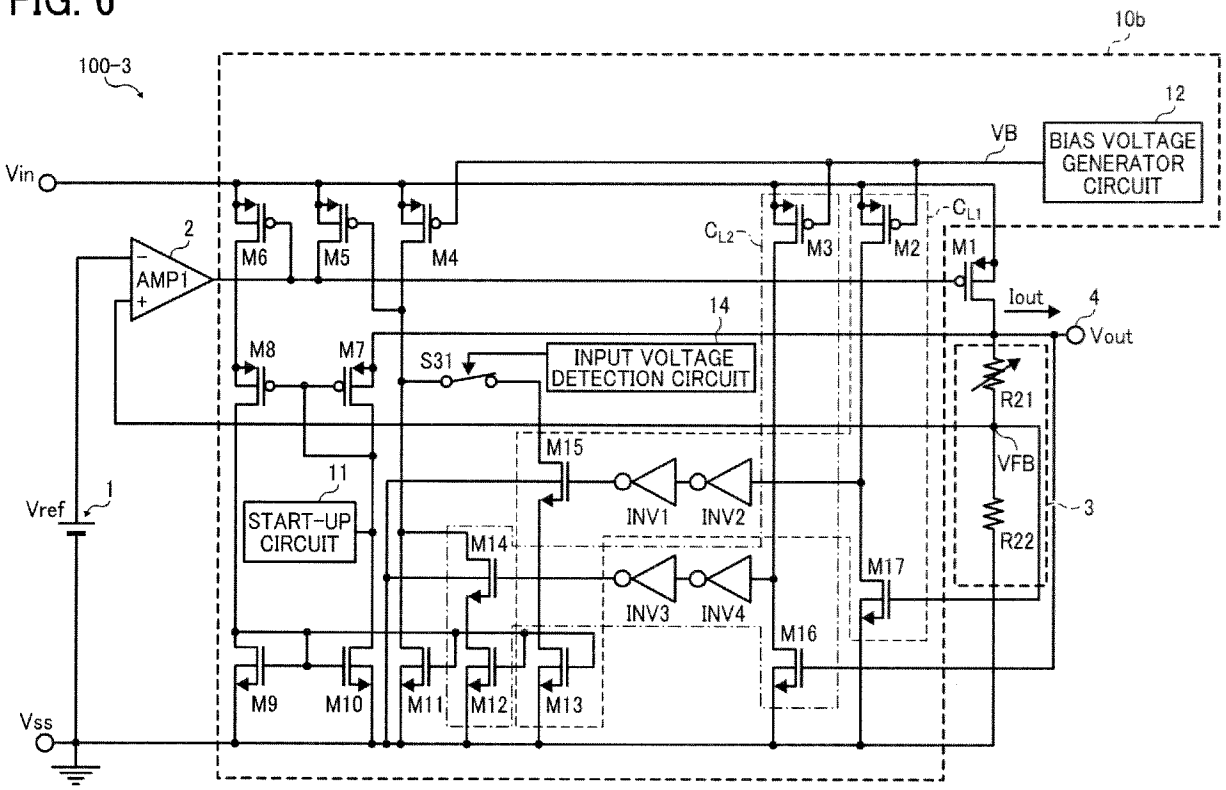
FIG. 6 is a circuit diagram illustrating a configuration of the constant-voltage circuit including an excess-current protection circuit and an input voltage detector circuit according to a third embodiment.
Figure 7:
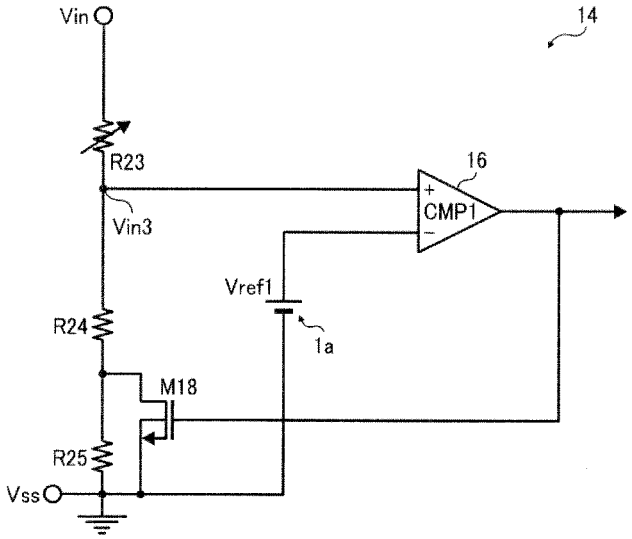
FIG. 7 is a circuit diagram illustrating a configuration of the input voltage detection circuit shown in FIG. 6.
Figure 8:
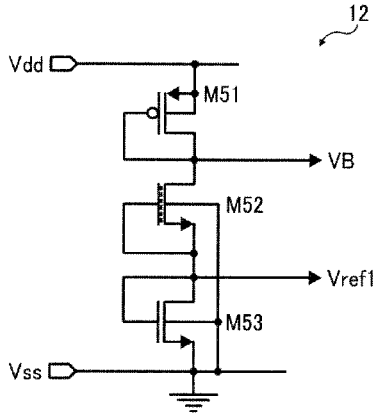
FIG. 8 is a circuit diagram illustrating a configuration of a bias voltage generator circuit that generates a bias voltage and a reference voltage, shown in FIGS. 3A, 3B, 5, and 6.

FIG. 6 is a circuit diagram illustrating a configuration of the constant-voltage circuit 100-3 including an excess-current protection circuit 10*b* and an input voltage detector circuit 14 according to a third embodiment. In addition, FIG. 7 is a circuit diagram illustrating a configuration of the input voltage detection circuit 14 shown in FIG. 6. FIG. 8 is a circuit diagram illustrating a configuration of the bias voltage generator circuit 12 that generates the bias voltage VB and a reference voltage Vref1. What is different from the constant-voltage circuit 100 shown in FIG. 3A is that the constant-voltage circuit 100-3 shown in FIG. 6 includes the input voltage detection circuit 14 that controls on and off of the switch S31 shown in FIG. 3A.

In FIG. 8, the bias voltage generator circuit 12 includes three MOS transistors M51, M52, and M53 connected between a power supply voltage Vdd and a ground voltage Vss. In the bias voltage generator circuit 12 shown in FIG. 8, the three MOS transistors M51, M52, and M53 divide the power supply voltage Vdd and the ground voltage Vss to generate the bias voltage VB and the reference voltage Vref1.

In FIG. 7, the input voltage detection circuit 14 includes a variable resistor R23, fixed resistors R24 and R25, a MOS transistor M18, a reference voltage source 1*a*, and a comparator 16. In the input voltage detection circuit 14, the comparator 16 compares a divided voltage Vin3 (junction voltage between the resistors R23 and R24) divided by the resistors R23 and R24 with the reference voltage Vref1. An output voltage of the comparator 16 is applied to the gate of the MOS transistor M18. When the input voltage Vin is decreased to a second voltage Vin2 that is lower than a predetermined input setting voltage set in advance from a first voltage that is higher than the predetermined input setting voltage, the junction voltage Vin3 between the resistors R23 and R24 is decreased from the first voltage Vin1 to the second voltage Vin2. Accordingly, the output voltage of the comparator 16 changes from high to low, and the switch S31 changes from on to off. At this time, the MOS transistor M18 is turned off.

Conversely, when the input voltage Vin is increased to the first voltage Vin1 from the second voltage Vin2, the junction voltage Vin3 between the resistors R23 and R24 is increased from the second voltage Vin2 to the first voltage vin1, the output voltage of the comparator 16 changes from low to high, and the switch S31 changes from off to on. At this time, the MOS transistor M18 is turned on.

As described above, in the present embodiment, the operation of the MOS transistor M18 functions as a hysteresis of the input voltage detection circuit 14 relative to the input voltage Vin. Herein, by adjusting and trimming the variable resistor R23, a detection voltage of the input voltage Vin can be set appropriately.

Figure 9:
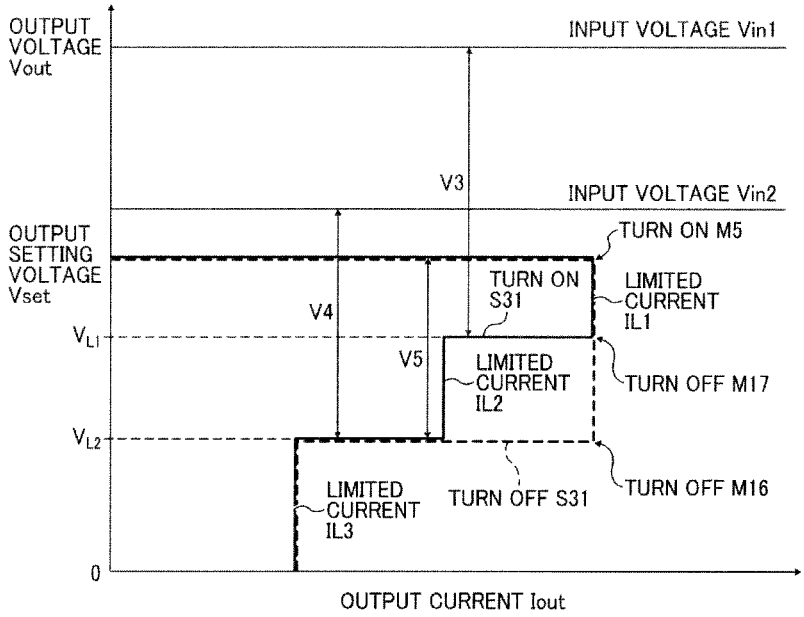
FIG. 9 is a graph illustrating the characteristics of an output voltage relative to an output current of the constant voltage circuit shown in FIG. 6.

FIG. 9 is a graph illustrating the characteristics of the output voltage Vout relative to the output current Iout of the constant-voltage circuit 100-3 shown in FIG. 6. With reference to FIG. 9, the effect of the constant-voltage circuit 100-3 is described below.

In FIG. 9, a solid line indicates the excess current protection operation when the input voltage Vin is the first voltage Vin1, the output voltage of the input voltage detection circuit 14 is high, and the switch S31 is on state. In order to decrease a voltage difference V3 between the first input voltage Vin1 and the limited voltage (this case, the first limited voltage $V_{L1}$) to minimize the heat generation, when the excess current flows through the constant-voltage circuit 100-3, the excess-current protection circuit 10*b* alternately changes the output voltage Vout and the output current Iout in stages.

By contrast, a broken line in FIG. 9 indicates the excess current protection operation when the input voltage Vin is the second voltage Vin2, the output voltage of the input voltage detection circuit 14 becomes low, and the switch S31 is off state. When the excess current flows through the constant-voltage circuit 100-3, although the excess-current protection circuit 10*b* changes the output voltage Vout and the output current Iout using the excess current protection operation having only one step corresponding to the operation of the second current limitation circuit $C_{L2}$, a voltage difference V4 between the second input voltage Vin2 and the limited voltage (this case, the second limited voltage $V_{L2}$) shown in FIG. 9 is smaller, which minimizes the heat generation. Since a voltage difference V5 between the output setting voltage Vset and the second limited voltage $V_{L2}$ shown in FIG. 9 has a certain great value, if the load is rapidly increased and the output voltage Vout is greatly undershoot, the failure that the output voltage Vout is not recovered is less likely to occur.

Fourth Embodiment

Figure 10:
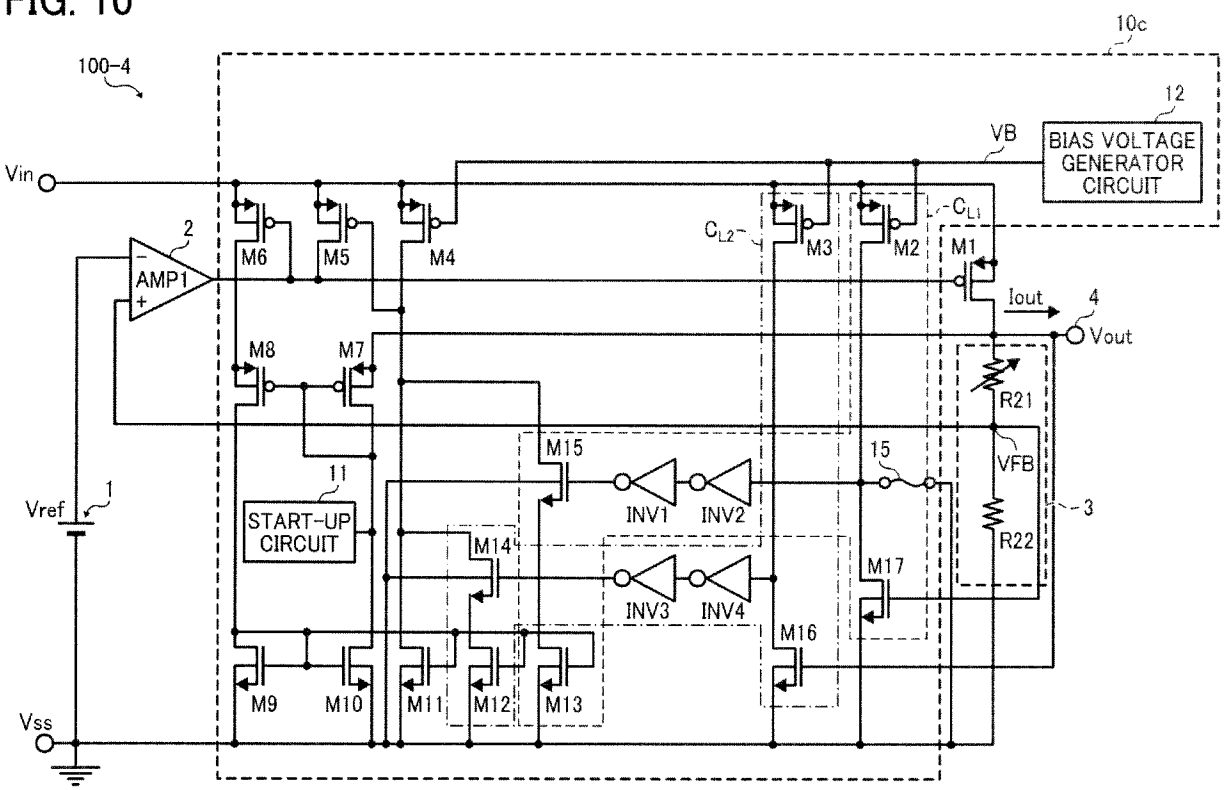
FIG. 10 is a circuit diagram illustrating a configuration of a constant-voltage circuit including an excess-current protection circuit according to a fourth embodiment.

FIG. 10 is a circuit diagram illustrating a configuration of a constant-voltage circuit 100-4 including an excess-current protection circuit 10*c*. What is different from the constant-voltage circuit 100-2 shown in FIG. 5 is described below. The drain of the MOS transistor M15 is connected to the drain of the MOS transistor M4. That is, a trimming fuse 15 is not connected to the MOS transistor M15. In addition, a junction node between the drain of the MOS transistor M2 and the drain of the MOS transistor M17 is connected to a ground voltage Vss via the trimming fuse 15. Herein, the trimming fuse 15 is cut when it is normally used. Herein, the trimming fuse 15 serves as the selection element to select whether the first current limitation circuit $C_{L1}$ is operated or stopped.

In above-configured constant-voltage circuit 100-4 according to the fourth embodiment while the trimming fuse 15 is cut, the excess-current protection circuit 10*c* operates at same operation when the switch S31 is on state in the excess current protection circuit 10 shown in FIG. 3A, which is indicated by the solid line shown in FIG. 4.

When the output setting voltage Vset is low, using the trimming fuse 15 without cutting, the excess-current protection circuit 10*c* operates the current protection operation, that does not operates the first step in stages, indicated by the broken line shown in FIG. 4. Therefore, if the load is rapidly increased and the output voltage Vout is greatly undershoot, the failure that the output voltage Vout is not recovered is less likely to occur.

Fifth Embodiment

Figure 11:
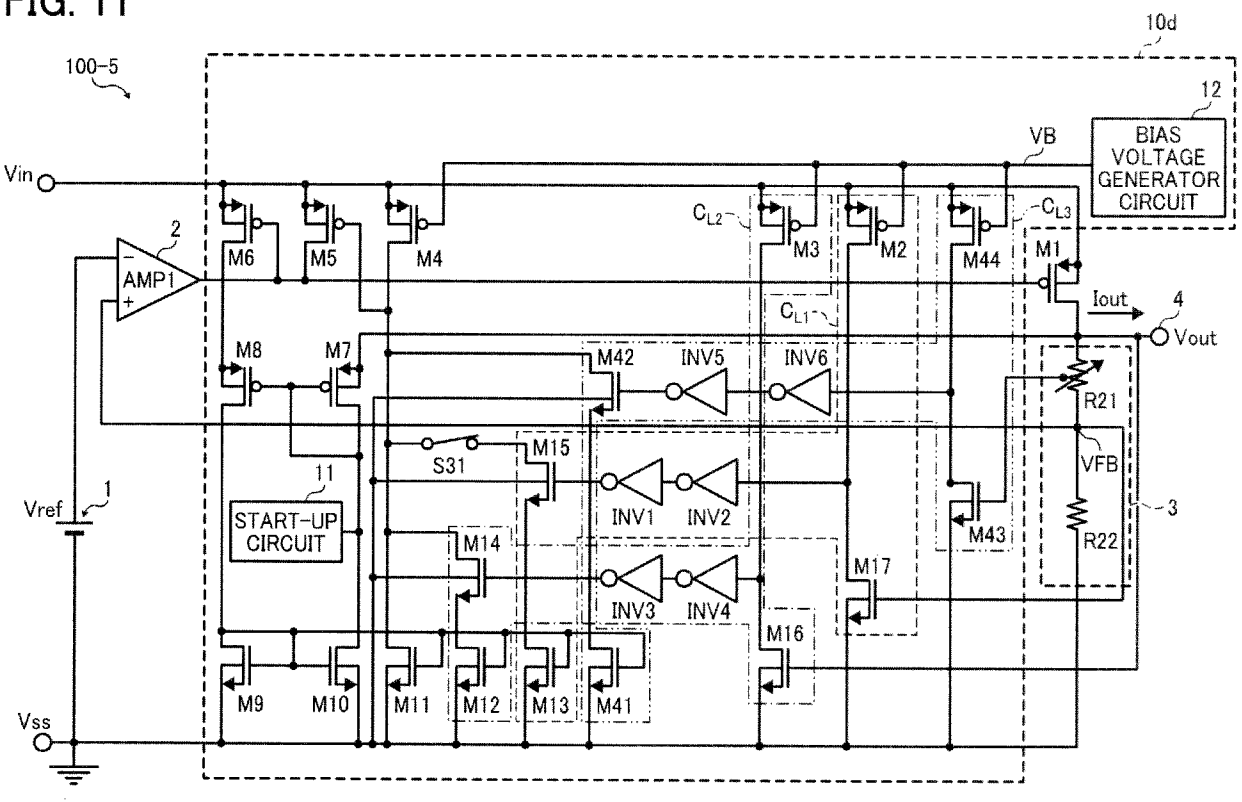
FIG. 11 is a circuit diagram illustrating a configuration of a constant-voltage circuit including an excess-current protection circuit according to a fifth embodiment.

FIG. 11 is a circuit diagram illustrating a configuration of a constant-voltage circuit 100-5 including an excess-current protection circuit 10*d* according to a fifth embodiment. What is different from the constant-voltage circuit 100 shown in FIG. 3A is that the constant-voltage circuit 100-5 shown in FIG. 11 further includes a third current limitation circuit $C_{L3}$ including MOS transistors M43 and M44, inverters INV5 and INV6, and MOS transistor M42 and M41 similarly to the first current limitation circuit $C_{L1}$ including the MOS transistors M2 and M17, the inverters INV1 and INV2, and the MOS transistor M13 and M15. In addition, the gate of the MOS transistor M43 is connected to a predetermined midpoint of the variable resistor R21.

Figure 12:
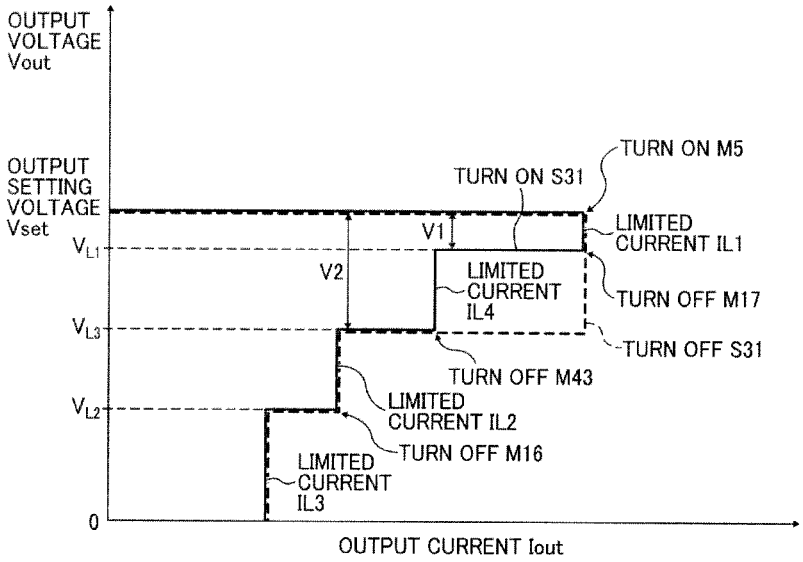
FIG. 12 is a graph illustrating the characteristics of an output voltage relative to an output current of the constant-voltage circuit shown in FIG. 11.

FIG. 12 is a graph illustrating the characteristics of the output voltage Vout relative to the output current Iout of the constant-voltage circuit 100-5 shown in FIG. 11. The operation of the constant-voltage circuit 100-5 is described below.

In a state in which the switch S31 is on in the constant-voltage circuit 100-5, as indicated by a solid line of FIG. 12, when the output voltage Vout is at or over a predetermined voltage, the MOS transistor M17 is set to be on. When the excess current flows and the output voltage Vout declines to the first limited voltage $V_{L1}$ through the above-described process, the output current Iout is kept at the first limited current IL1, and the junction voltage VFB between the resistors R21 and R22 in the output voltage detection circuit 3 is decreased, which decreases the gate voltage of the MOS transistor M17. Then, as the gate voltage of the MOS transistor M17 is decreased, the MOS transistor M17 is turned off. When the drain voltage of the MOS transistor M17 exceeds the first threshold value of the inverter INV2, the MOS transistor M15 is turned on, the gate-source voltage of the MOS transistor M5 is increased, and the gate voltage of the output MOS transistor M1 is increased, which decreases the output current Iout of the constant-voltage circuit 100-5. Accordingly, the output current Iout is decreased from the first limited current IL1 to a fourth limited current IL4.

Subsequently, when the output voltage Vout is decreased to a third limited voltage $V_{L3}$ intermediate between the first limited voltage $V_{L1}$ and the second limited voltage $V_{L2}$, the MOS transistor M43 is turned off. Then, when the drain voltage of the MOS transistor M43 exceeds a third threshold value of the inverter INV6, the MOS transistor M42 is switched on and the gate-source voltage of the MOS transistor M5 is further increased, the gate-voltage of the output MOS transistor M1 is increased. Accordingly, the output current Iout of the constant-voltage circuit 100-5 is further decreased from the fourth limited current IL4 to the second limited current IL2.

Then, when the output voltage Vout declines to the second limited voltage $V_{L2}$ through the above-described process, the MOS transistor M16 is off. When the drain voltage of the MOS transistor M16 exceeds the threshold value of the inverter INV4, the MOS transistor M14 is turned on, the gate-source voltage of the MOS transistor M5 is further increased, the gate voltage of the output MOS transistor M1 is increased. Accordingly, the output current Iout of the constant-voltage circuit 100-5 is decreased from the second limited current IL2 to the third limited current IL3.

As described above, in the present embodiment as indicated by the solid line shown in FIG. 12, the constant-voltage circuit 100-5 changes the output voltage Vout and the output current Iout change in stages.

Conversely, in the excess current protection operation when the switch S31 is off, as indicated by the broken line shown in FIG. 12, when the excess current flows and the output voltage Vout declines to the first limited voltage $V_{L1}$ through the foregoing process, the MOS transistor M17 is turned off. The output current Iout at this time is the first limited current IL1. In a state in which the drain-voltage of the MOS transistor M17 exceeds the first threshold voltage of the inverter INV2, the gate-source voltage of the MOS transistor M5 is not affected, which prevents the gate voltage of the output MOS transistor M1 from increasing and prevents the output current Iout of the constant-voltage circuit 100-5 from decreasing.

Next, the effect of the fifth embodiment is described below with reference to FIG. 12. In FIG. 12, the solid line indicates the excess current protection operation when the switch S31 is on. Herein, when the output setting voltage Vset is low, a voltage difference V1 between the output setting voltage Vset and the limited voltage (in this case the first limited voltage $V_{L1}$) shown in FIG. 12 is smaller. At this time, if the output voltage Vout is greatly undershoot as the load is rapidly increased, the failure that the output voltage Vout is not recovered is likely to occur.

Conversely, the broken solid line shown in FIG. 12 indicates the excess current protection operation when the switch S31 is off. Herein, if the output setting voltage Vset is low, a voltage difference V2 between the output setting voltage Vset and the limited voltage (in this case the third limited voltage $V_{L3}$) of FIG. 12 is kept at a certain great value. Therefore, if the output voltage Vout is greatly undershoot as the load is rapidly increased, the above-described recovery failure is less likely to occur.

The above-described constant-voltage circuits 100, 100-1, 100-2, 100-3, 100-4, and 100-5 can be installed in electronically device, such as, a portable phone a portable player.

In addition, as described above, the above-described constant-voltage circuits 100, 100-1, 100-2, 100-3, 100-4, and 100-5 can correspond to both system that can operate under low input voltage and system having an output voltage side connected to a load that significantly fluctuates, using a single chip of same configuration. Accordingly, development cost and manufacturing cost can be reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A constant voltage circuit comprising:

an output terminal to output an output voltage;

an output control transistor to control an output current from the output terminal to keep the output voltage constant at a predetermined set voltage; and an excess-current protection circuit to control the output control transistor to prevent an output current, output from the output control transistor, from exceeding a predetermined value, the excess-current protection circuit comprising:

a current increase restriction element to restrict increase in the output current from the output control transistor to decrease the output voltage from the output terminal;

a first current limitation circuit to limit a gate voltage of the output control transistor to decrease the output current when the output voltage decreases to a first limited voltage from the predetermined set voltage;

a second current limitation circuit to limit the gate voltage of the output control transistor to decrease the output current when the output voltage decreases to a second limited voltage that is smaller than the first limited voltage from the predetermined set voltage or the first limited voltage; and a selection element to select whether the first current limitation circuit is operated or stopped; and a third current limitation circuit to limit the gate voltage of the output control transistor to decrease the output current when the output voltage decreases to a third limited voltage intermediate between the first limited voltage and the second limited voltage from the predetermined set voltage or the first limited voltage.

2. The constant voltage circuit according to claim 1, wherein the selection element of the excess-current protection circuit comprises a trimming fuse.

3. The constant voltage circuit according to claim 1, further comprising an input detection circuit to detect an input voltage supplied to the constant voltage circuit and switch a selection operation of the selection element depending on the input voltage supplied via the selection element.

4. The constant voltage circuit according to claim 1, further comprising:

an output-abnormal detection circuit to detect an abnormal state of the output voltage of the constant voltage circuit and switch a selection operation of the selection element depending on an input voltage supplied to the constant voltage circuit via the selection element.

5. The constant voltage circuit according to claim 1, wherein the excess-current protection circuit further comprises a constant current circuit.

6. The constant voltage circuit according to claim 1, wherein the excess-current protection Circuit further comprises a proportional current generator to generate a current proportional to the output current.

7. The constant voltage circuit according to claim 1, further comprising an output voltage detection circuit to detect the output voltage of the output terminal, and divide the output voltage to generate a divided voltage to the first current limitation circuit of the excess-current protection circuit.

8. The constant voltage circuit according to claim 7, further comprising:

a reference voltage generator to generate a reference voltage; and an amplifier to amplify a difference between the divided voltage and a reference voltage corresponding to the output voltage, wherein the reference voltage generator, the amplifier, and the current increase restriction element of the excess-current protection circuit together function as a current increase restriction circuit to restrict increase in the output current from the output control transistor to decrease the output voltage from the output terminal.

9. The constant voltage circuit according to claim 7, wherein the first current limitation circuit comprises:

a first detection transistor to generate a first drain voltage depending on the divided voltage from the output detection circuit, a first inverter to generate a first threshold voltage; and a first operation transistor to switch on when the first drain voltage of the first detection transistor exceeds the first threshold voltage of the first inverter.

10. The constant voltage circuit according to claim 9, wherein the second current limitation circuit comprises:

a second detection transistor to generate a second drain voltage depending on the output voltage of the output terminal;

a second inverter to generate a second threshold voltage; and a second operation transistor to switch on when the second drain voltage of the second detection transistor exceeds the second threshold voltage of the second inverter.

11. An electronic device comprising the constant voltage circuit of claim 1.

12. A constant voltage circuit comprising:

an output terminal to output an output voltage;

an output control transistor to control an output current from the output terminal to keep the output voltage constant at a predetermined set voltage; and an excess-current protection circuit to control the output control transistor to prevent an output current, output from the output control transistor, from exceeding a predetermined value, the excess-current protection circuit comprising:

a current increase restriction element to restrict increase in the output current from the output control transistor to decrease the output voltage from the output terminal;

a first current limitation circuit to limit a gate voltage of the output control transistor to decrease the output current when the output voltage decreases to a first limited voltage from the predetermined set voltage;

a second current limitation circuit to limit the gate voltage of the output control transistor to decrease the output current when the output voltage decreases to a second limited voltage that is smaller than the first limited voltage from the predetermined set voltage or the first limited voltage; and a selection element to select whether the first current imitation circuit is operated or stopped, wherein the selection element of the excess-current protection circuit comprises a switch to switch between (i) operating the first current limitation circuit and (ii) stopping operation of the first current limitation circuit, and wherein the constant voltage circuit further comprises a third current limitation circuit to limit the gate voltage of the output control transistor to decrease the output current when the output voltage decreases to a third limited voltage intermediate between the first limited voltage and the second limited voltage from the predetermined set voltage or the first limited voltage.

* * * * *